US010865951B2

(12) United States Patent
Zhong et al.

(10) Patent No.: US 10,865,951 B2
(45) Date of Patent: Dec. 15, 2020

(54) ELONGATED INDUSTRIAL LIGHT

(71) Applicant: ABB Schweiz AG, Baden (CH)

(72) Inventors: Sheng Zhong, Hillsborough, NC (US); Darren Tremelling, Apex, NC (US); Corey Stoner, Okatie, SC (US); Matt Hetrich, Raleigh, NC (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/106,357

(22) Filed: Aug. 21, 2018

(65) Prior Publication Data

US 2020/0063925 A1 Feb. 27, 2020

(51) Int. Cl.

| | |
|---|---|
| ***F21V 15/01*** | (2006.01) |
| ***F21S 4/20*** | (2016.01) |
| ***F21K 9/275*** | (2016.01) |
| ***F21V 7/04*** | (2006.01) |
| ***F21V 19/00*** | (2006.01) |
| *F21W 131/40* | (2006.01) |
| *F21Y 115/10* | (2016.01) |
| *F21Y 103/10* | (2016.01) |
| *F21Y 103/33* | (2016.01) |

(52) U.S. Cl.

CPC ..... *F21S 4/20* (2016.01); *F21K 9/275* (2016.08); *F21V 7/043* (2013.01); *F21V 19/003* (2013.01); *F21W 2131/40* (2013.01); *F21Y 2103/10* (2016.08); *F21Y 2103/33* (2016.08); *F21Y 2115/10* (2016.08)

(58) Field of Classification Search

CPC ..... F21S 4/28; F21S 4/20; F21Y 2103/10
USPC ..... 362/217.01
See application file for complete search history.

(56) References Cited

U.S. PATENT DOCUMENTS

| | | | | |
|---|---|---|---|---|
| 6,309,081 | B1 | 10/2001 | Furihata | |
| 6,361,186 | B1 * | 3/2002 | Slayden | F21V 3/02 362/241 |
| 6,583,550 | B2 | 6/2003 | Iwasa et al. | |
| 7,053,557 | B2 | 5/2006 | Cross et al. | |
| 7,350,936 | B2 | 4/2008 | Ducharme et al. | |
| 7,438,441 | B2 | 10/2008 | Sun et al. | |
| 7,478,924 | B2 | 1/2009 | Robertson | |
| 7,946,729 | B2 | 5/2011 | Ivey et al. | |
| 7,997,770 | B1 | 8/2011 | Meurer | |
| 8,115,411 | B2 | 2/2012 | Shan | |
| 8,444,292 | B2 | 5/2013 | Ivey et al. | |
| 8,678,610 | B2 | 3/2014 | Simon et al. | |
| 9,151,452 | B2 | 10/2015 | Chiang | |
| 2005/0122472 | A1 * | 6/2005 | Fisher | G02C 7/02 351/159.06 |
| 2007/0242466 | A1 * | 10/2007 | Wu | F21V 19/008 362/362 |

(Continued)

OTHER PUBLICATIONS

Polymer Properties Database; Refractive Index of Amorphous Polymers; 2 pgs.; Copyright 2015; polymerdatabase.com.

*Primary Examiner* — Christopher M Raabe
(74) *Attorney, Agent, or Firm* — Taft Stettinius & Hollister LLP; J. Bruce Schelkopf

(57) ABSTRACT

An industrial light is provided with an elongated housing or body and a power conversion module. The elongated housing has an interior space and a strip of LEDs disposed within the interior space. The LEDs may also be embedded within an elongated body. Brackets may be used to connect the light to a conduit such that the elongated housing is parallel to the conduit.

20 Claims, 8 Drawing Sheets

(56) References Cited

U.S. PATENT DOCUMENTS

| | | | | |
|---|---|---|---|---|
| 2010/0110685 | A1* | 5/2010 | Pei | F21V 23/02 362/249.02 |
| 2010/0172149 | A1* | 7/2010 | Siemiet | F21S 4/28 362/555 |
| 2012/0153865 | A1* | 6/2012 | Rolfes | F21V 23/003 315/294 |
| 2012/0236562 | A1* | 9/2012 | Tran | F21V 19/0045 362/249.02 |
| 2013/0077297 | A1 | 3/2013 | Wu et al. | |
| 2014/0071668 | A1* | 3/2014 | Ai | F21S 2/00 362/219 |
| 2014/0268727 | A1* | 9/2014 | Amrine, Jr. | F21V 3/02 362/224 |
| 2014/0376231 | A1* | 12/2014 | Cox, Jr. | F21V 29/70 362/294 |
| 2015/0276139 | A1* | 10/2015 | Rowlette, Jr. | F21V 19/003 362/249.06 |
| 2016/0348851 | A1* | 12/2016 | Amrine, Jr. | F21V 23/023 |
| 2018/0045387 | A1* | 2/2018 | Roach | B60Q 1/2607 |

* cited by examiner

ELONGATED INDUSTRIAL LIGHT

BACKGROUND

The present inventions relate generally to lighting, and more particularly, to an elongated LED light for industrial uses.

Industrial lighting may be required to satisfy a number of different requirements. Preferably, industrial lighting covers a broad area with a uniform distribution of light. Industrial lights are also preferably compact and unobtrusive. Further, industrial lighting must be reliable and preferably energy efficient.

In addition, in some environments it is necessary for industrial lighting to be sealed and protected from the surrounding environment. For example, in marine environments lighting must be suitable to prevent water and salt spray from entering the light fixture. The food and beverage industries also require sealed lighting to prevent product materials from infiltrating light components.

Hazardous environments also require lighting to be designed to contain any explosions that may occur within the light. Conventionally, industrial lights are supplied with electricity of high voltage (>50V) and require multiple components (e.g., ballast for controlling characteristics of electricity to the luminous component, interface for mechanical and electrical connections to the luminous component, and a luminous component). Due to the high voltage nature of the power supply needed and the high voltage nature of the florescent, incandescent, or high intensity discharge luminous components, lighting components are oftentimes separated with significant space for creepage and clearance requirements. In hazardous environments, it is assumed that explosive gases will infiltrate all spaces in the work environment (including lighting therein), and upon ignition, overpressure will be created in confined spaces. If a confined space is within an electrical device, the device must be mechanically designed so that it is not destroyed by the overpressure created after ignition.

The inventors believe that improved lighting systems suitable for industrial environments are desirable.

SUMMARY

A light is described for industrial environments. The light includes a power conversion module and an elongated housing with a translucent portion. A plurality of LEDs is disposed within an interior space of the elongated housing. The LEDs may also be embedded within an elongated body. A bracket may also be provided to attach the light to a conduit.

One advantage of the described lights is that a greater selection of materials may be used for the elongated housing or body. The pressure in a long thin wall pressure vessel can be approximated by stress=pressure*diameter/(2*wall thickness). Thus, if the diameter of the industrial lighting system is reduced, the resultant stress will be reduced.

BRIEF DESCRIPTION OF SEVERAL VIEWS OF THE DRAWINGS

The invention may be more fully understood by reading the following description in conjunction with the drawings, in which.

DETAILED DESCRIPTION

Figure 1A:
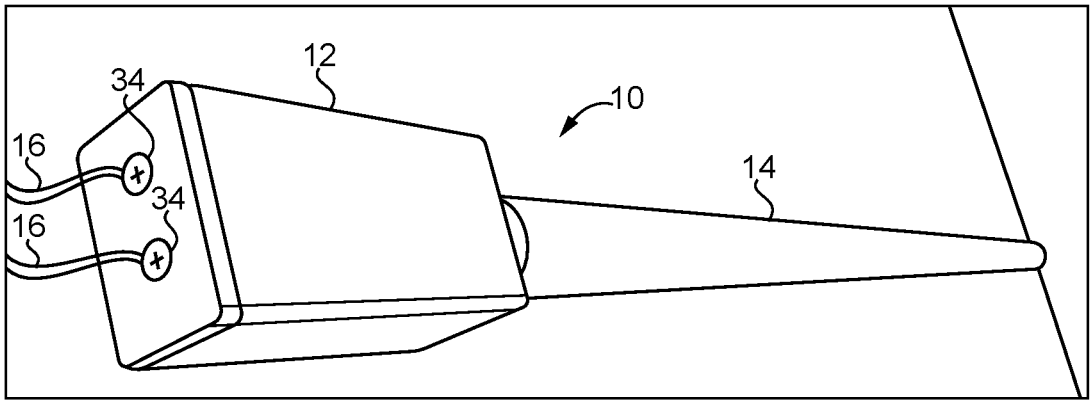
FIG. 1A is a perspective view of one end of a light.
Figure 1B:
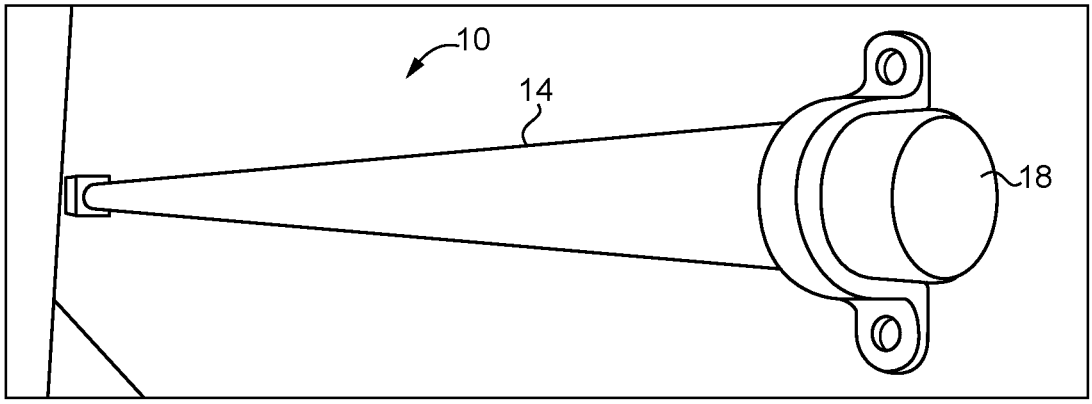
FIG. 1B is a perspective view of another end of the light.

Referring now to the figures, and particularly FIGS. 1A and 1B, an embodiment of an industrial light 10 is shown. In FIG. 1A, a first end of the light 10 is shown with a power conversion module 12 attached to an elongated housing 14. As shown, electrical wires 16 are connected to the power conversion module 12 to supply power to the power conversion module 12. Preferably, any access covers or other openings to the interior of the power conversion module 12 are hermetically sealed to allow the light 10 to be used in industrial environments like marine environments and food and beverage production environments.

Extending from the power conversion module 12 is an elongated housing 14. Preferably, the elongated housing 14 extends in a straight direction and has a length at least 10 times the width of the housing 14. As shown in FIG. 1B, the end of the elongated housing 14 opposite from the power conversion module 12 is provided with a cap 18. The cap 18 is preferably hermetically sealed to the elongated housing 14. For example, the cap 18 may be attached to the elongated housing 14 with an adhesive.

Figure 2:
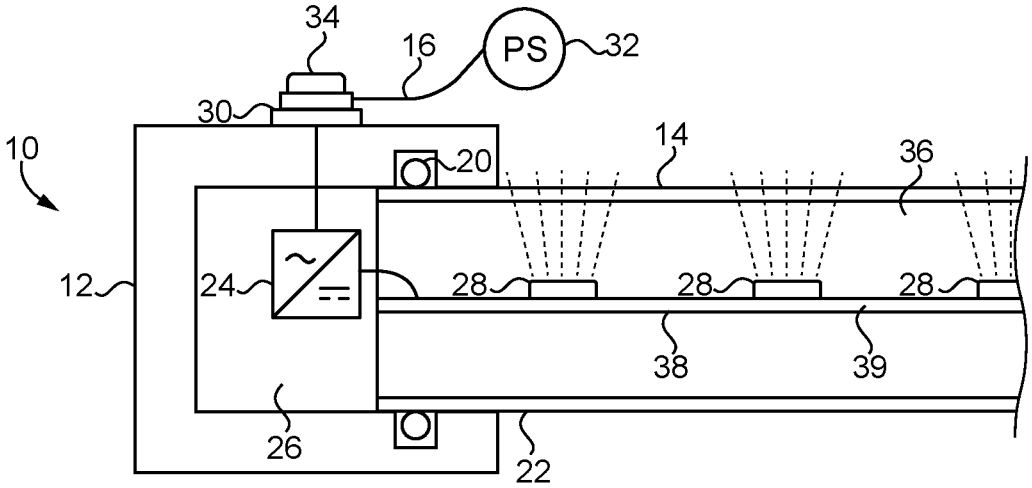
FIG. 2 is a cross-sectional view of an embodiment of the light.

The power conversion module 12 and elongated housing 14 are shown in more detail in FIG. 2. Preferably, as shown, a seal 20 is provided between the power conversion module 12 and the elongated housing 14 to hermetically seal the attachment between the module 12 and the housing 14. Thus, as described, the entire structure of the light 10 is hermetically sealed to allow the light 10 to be used in industrial environments where concerns may exist about fluid, particles or gas infiltration into the light 10. If desired, the power conversion module 12 may be removably attached to the end of the elongated housing 14 to allow access for maintenance of the power conversion module 12 or the elongated housing 14. For example, as shown, the power conversion module 12 and the seal 20 may slide over the outer surface 22 of the elongated housing 14. In such an arrangement, it may be preferred for the outer surface 22 of the elongated housing 14 to be smooth.

A power converter 24 may be mounted within an interior space 26 of the power conversion module 12. Although various power converters may be used, a conventional AC to DC converter 24 may be used that converts common AC power to DC power sufficient to power the LEDs 28 of the light 10. Alternatively, a DC to DC power converter may be used in some applications. The input of the power converter 24 may be connected through the module wall to exterior terminal contacts 30 if desired. Preferably, the terminal contacts 30 on the exterior surface may be covered to prevent inadvertent access to the contacts 30. Electrical wires 16 from a power supply 32 may then be connected to the terminal contacts 30, for example, with screws 34. Alternatively, the input for the power converter 24 may include leads extending out through the module wall which are connected to the power supply 32 with wire nuts. Various designs may be used to supply power into the power conversion module 12, but it is preferred that whichever design is chosen that the power conversion module 12 remains sealed.

The elongated housing 14 is provided with an elongated interior space 36 extending through the housing 14. Located within the interior space 36 is a strip or multiple strips 38 of LEDs 28. If desired, the LEDs 28 may be attached to an elongated printed circuit board 39. The LEDs 28 may be equally spaced along the entire length of the elongated housing 14, but preferably along at least a majority of the length. The output of the power converter 24 is connected to the strip 38 of LEDs 28 to power the LEDs 28. At least a portion of the elongated housing 14 is made of a translucent material to allow light from the LEDs 28 to pass outward therethrough to provide light outside of the housing 14. The translucent portion may be elongated along at least the length of the LEDs 28 located within the housing 14.

Figure 3:
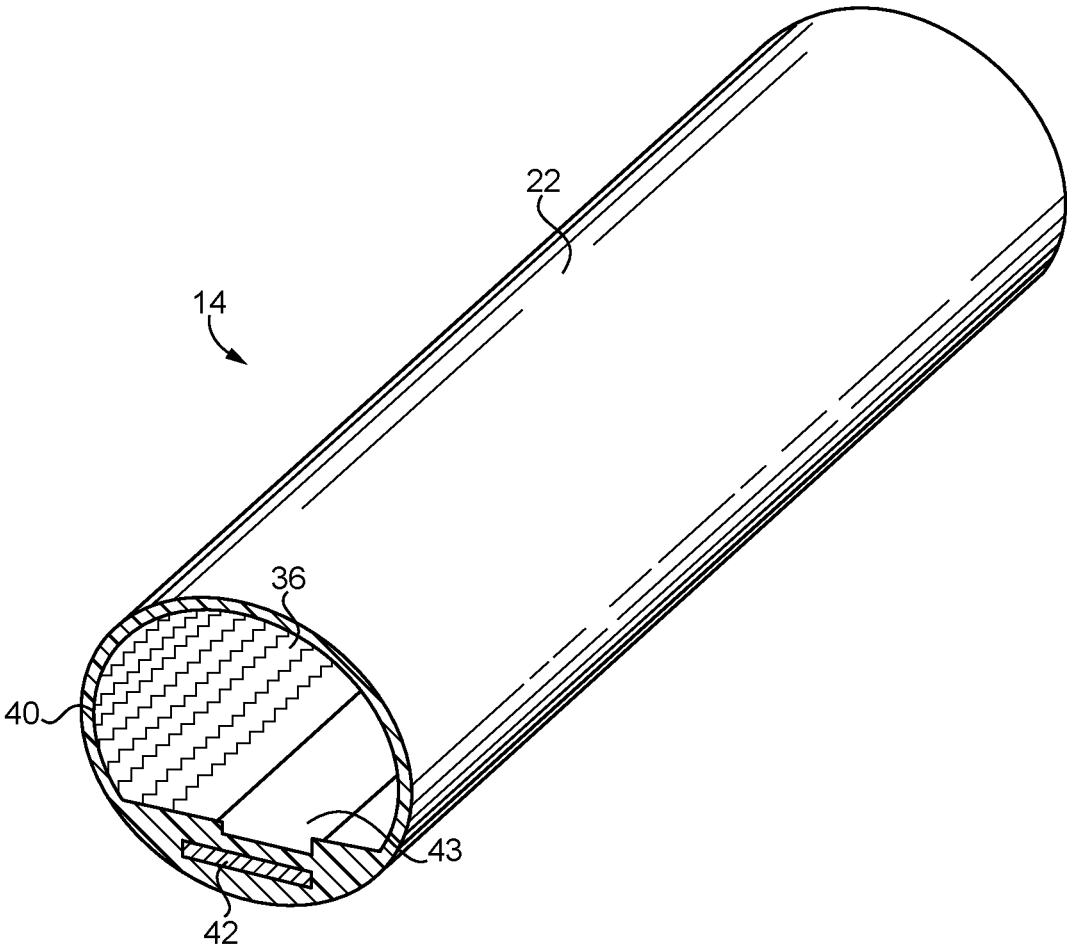
FIG. 3 is a perspective view of an elongated housing.

As shown in FIG. 3, it may be desirable for the elongated housing 14 to be made as a tube 14 formed from a translucent material. If desired, the tube 14 may have a uniform cross-section along the entire length of the tube 14. For example, the tube 14 may be made via extrusion. Preferably, the outer surface 22 of the elongated housing 14 is smooth along the length thereof so that the elongated housing 14 does not easily collect particles like dust, or so that the housing 14 may be easily cleaned. By contrast, the inner surface 40 of the housing 14 is preferably provided with a prismatic surface 40 to spread light from the LEDs 28. It may also be desirable to provide the elongated housing 14 with a metallic structural member 42 extending along the length of the housing 14 to provide stiffness to the housing 14. The metallic structural member 42 may also be useful in spreading heat generated by the LEDs 28 or directing light from the LEDs 28. As shown, the metallic structural member 42 may be embedded within a wall of the housing 14. For example, the structural member 42 may be fed through an extruder as the tubular housing 14 is extruded. The structural member 42 may also be overmolded by injection molding to form the housing 14. As shown, an interior groove 43 may also be formed in the extruded tube 14 for the strip 38 of LEDs 28.

Figure 4:
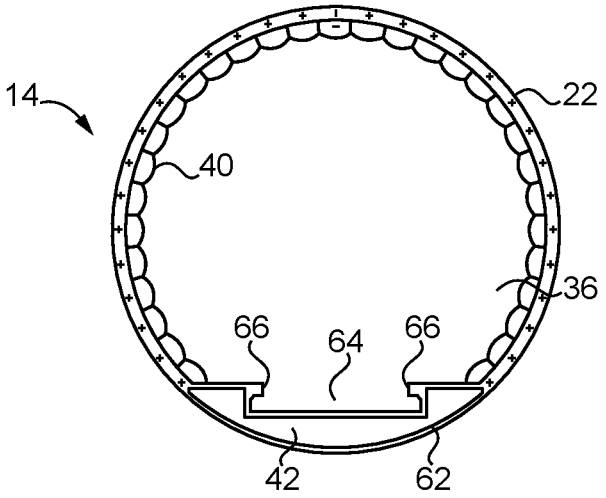
FIG. 4 is a cross-sectional view of an embodiment of the elongated housing.

As shown in FIG. 4, the metallic structural member 42 may have a rounded surface 62 that conforms to the tube 14 and may have a recess 64 for the strip 38 of LEDs 28. Ribs 66 may also be provided within the recess 64, either by the tube 14 or the structural member 42, to retain the strip 38 of LEDs 28 within the recess 64. The recess may be a uniform groove 64 along the length of the tube 14.

Figure 5:
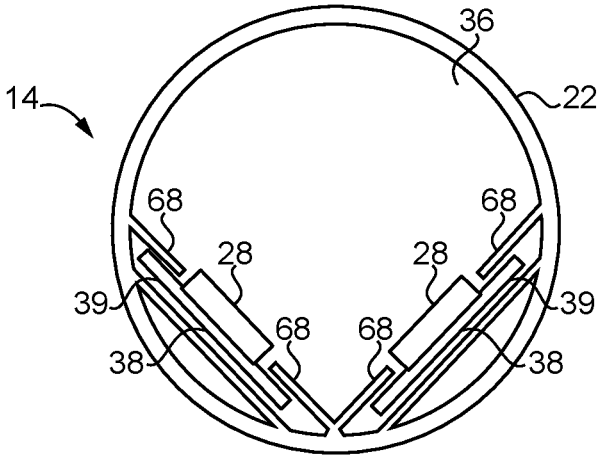
FIG. 5 is a cross-sectional view of another embodiment of the elongated housing.

As shown in FIG. 5, the interior of the tube 14 may be provided with support structures 68 to retain the LEDs 28. Preferably, the support structures 68 are integral with the tube 14. Thus, where the tube 14 is extruded, the support structures 68 extend longitudinally along the length of the tube 68 such that the tube 14 and integral support structures 68 form a uniform cross-section along the length. As shown in FIG. 5, the tube 14 may be provided with two support structures 68 that are angled relative to each other. This allows one strip 38 of LEDs 28 to be retained in one support structure 68 and another strip 38 of LEDs 28 to be retained in the other support structure 68. Although FIG. 5 shows the LEDs 28 angled toward each other so that the emitted light will predominantly overlap, it is also possible that the LEDs 28 could be angled away from each other.

Figure 6:
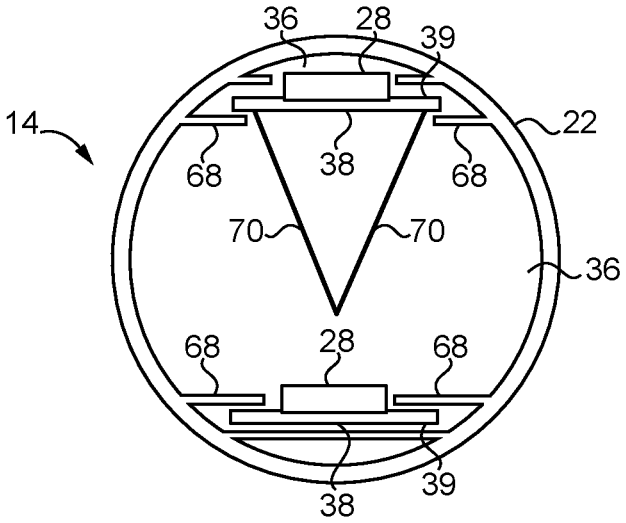
FIG. 6 is a cross-sectional view of another embodiment of the elongated housing.

As shown in FIG. 6, the strips 38 of LEDs 28 may also be aligned with each other with one strip 38 in front of the other. In this arrangement, it may be desirable to attach a reflector 70 behind the front strip 38 to redirect light from the rear strip 38 to the sides. The reflector 70 may be attached to the bottom of the printed circuit board 39 for the top strip 38 of LEDs or to the tube 14 or other structure.

Figure 7:
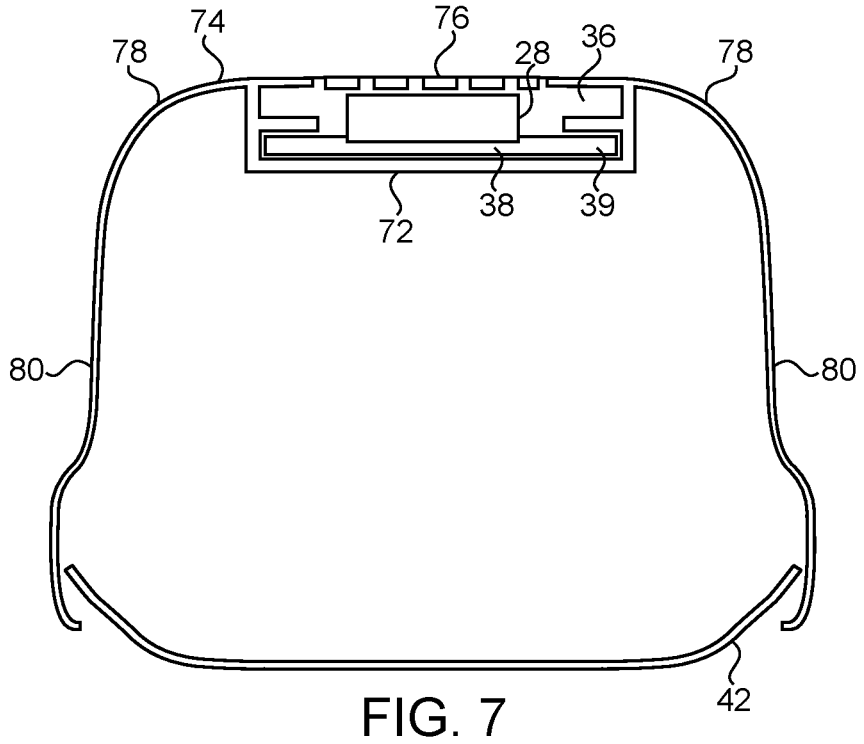
FIG. 7 is a cross-sectional view of another embodiment of the elongated housing.

As shown in FIG. 7, a support structure 72 may be integrally formed behind a front surface 74 of the elongated housing 14. If desired, the elongated housing 14 may be formed by co-extruding a translucent portion 76 on the front surface 74 and opaque portions 78 on the side of the elongated housing 14. As shown in this embodiment, the LEDs 28 may be located within an enclosed cavity 36 of the support structure 72. The elongated housing 14 may also include arms 80 that wrap around at least a portion of a metallic support member 42.

Figure 8:
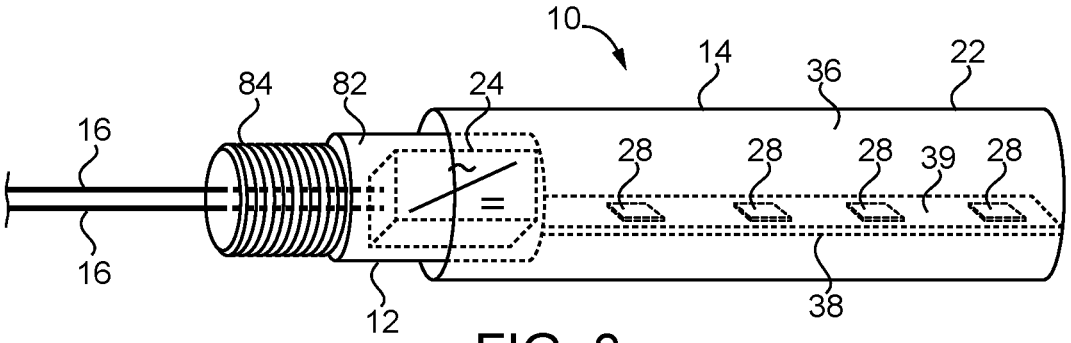
FIG. 8 is a side perspective view of an embodiment of the power conversion module.
Figure 9:
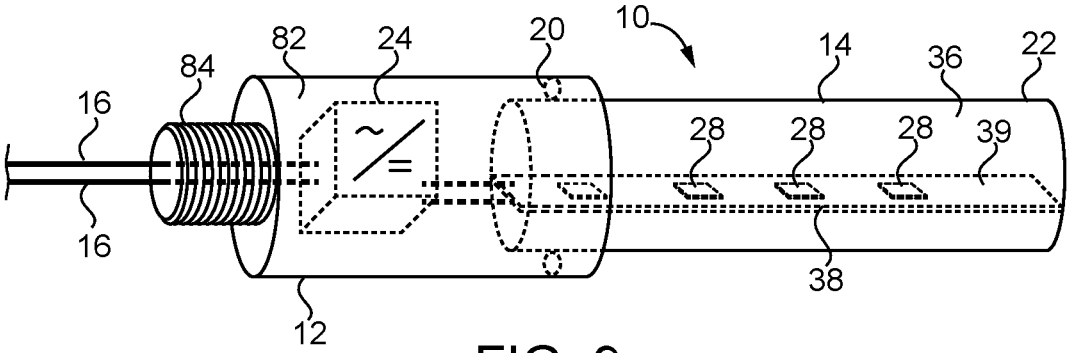
FIG. 9 is a side perspective view of another embodiment of the power conversion module.

As shown in FIGS. 8-9, where the elongated housing 14 is a tube 14, the power conversion module 12 may be either inserted into the tube 14 as in FIG. 8 or slid over the tube 14 as in FIG. 9. It is also possible for the power conversion module 12 to be attached to the elongated housing 14 with an adhesive (e.g., FIG. 8), or an O-ring seal 20 may be used between the power conversion module 12 and the elongated housing 14 to seal the connection therebetween (e.g., FIG. 9). In order to minimize the size of the power conversion module 12 and eliminate cavities therein, it may be desirable to overmold a polymer body 82 around the power converter 24 and the electrical wires 16 connected to the power converter 24. Thus, the power converter 24 and the portion of the electrical wires 16 connected to the power converter 24 are embedded within the polymer body 82 without any cavities (or crevices) therein. The polymer body 82 may also be formed with threads 84 to connect the power conversion module 12 to an electrical conduit. In such an arrangement, the electrical wires 16 may be embedded within the threaded portion 84 and extend out the end thereof. Thus, where the power conversion module 12 is directly threaded to a conduit, the electrical wires 16 may be fed directly into the conduit from the end of the threaded portion 84.

Figure 10:
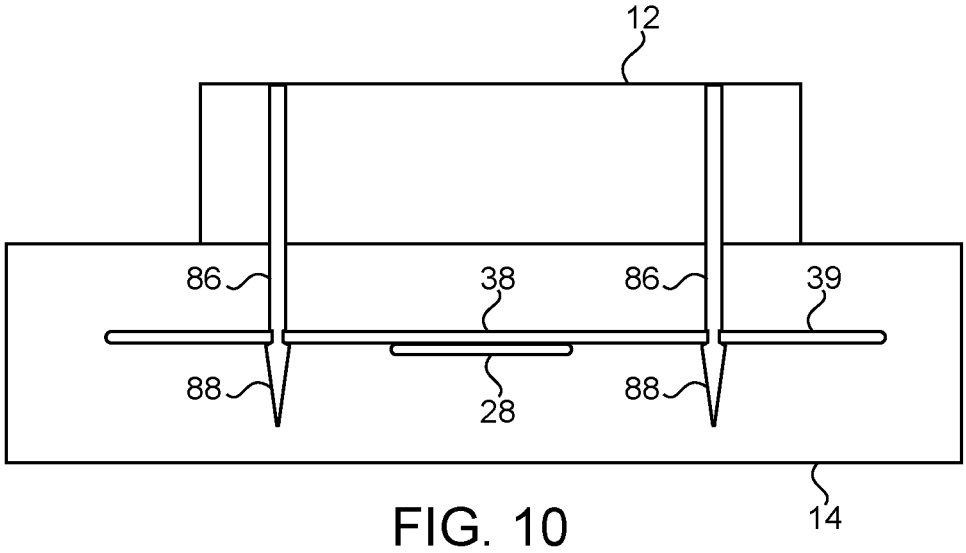
FIG. 10 is a side perspective view of an embodiment of the power conversion module.

As shown in FIG. 10, in some embodiments where the LEDs 28 are retained within a softer elongated housing 14 or body 14, it may be desirable for electrical leads 86 to penetrate the elongated housing 14 or body 14 to electrically connect to the strip 38 of LEDs 28. For example, the leads 86 may be provided with sharp tips 88 that are capable of piercing the material of the elongated housing 14 or body 14. The leads 86 may then extend out of the elongated housing 14 or body 14 to be connected to the power conversion module 12. In such an arrangement, the leads 86 may be fixedly connected to the power conversion module 12 so that the power conversion module 12 is pressed toward the elongated housing 14 or body 14 until the leads 86 penetrate the material of the housing 14 or body 14 and make electrical contact with the strip 38 of LEDs 28.

Figure 11:
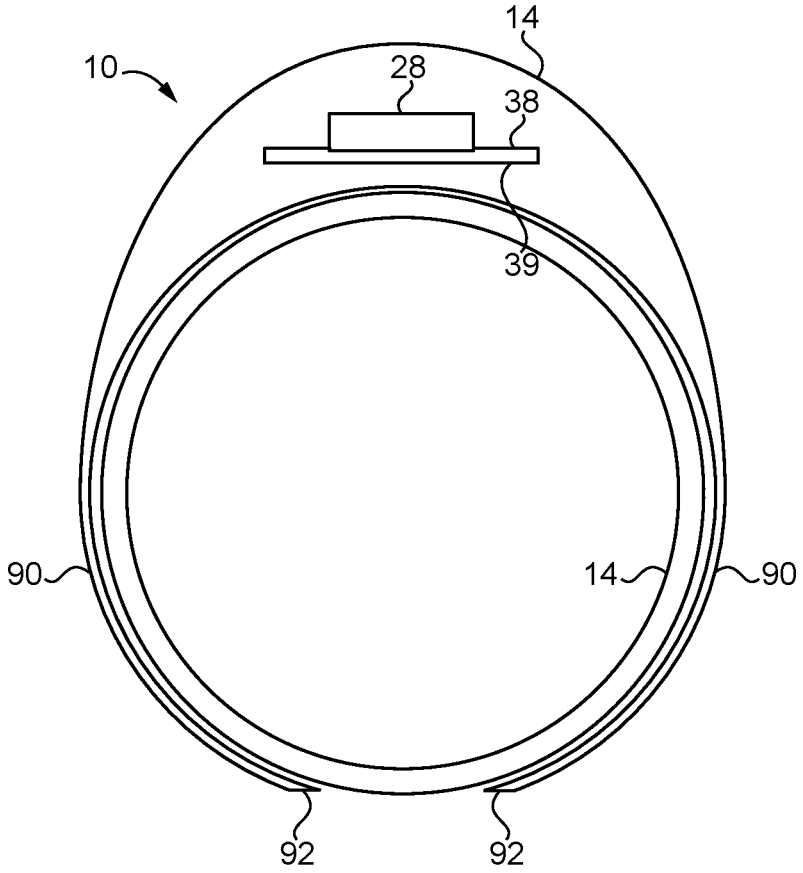
FIG. 11 is a cross-sectional view of another embodiment of the light.

As shown in FIG. 11, the strip 38 of LEDs 28 may alternatively be embedded within an elongated body 14 without any interior space therein. The elongated body 14 may be a polymer that is coextruded around the strip 38 of LEDs 28. Although the entire body 14 may be formed of a translucent polymer, it is also possible for only the portion covering the LEDs 28 to be translucent. In this arrangement, the power conversion module 12 can connect to the strip 38 of LEDs 28 as shown in FIG. 10, or one end of the strip 38 or lead wires 16 connected thereto may extend out the end of the elongated body 14 to connect to the power conversion module 12. As shown, the elongated body 14 may also be provided with arms 90 that wrap around a conduit 44 to attach the light 10 to the conduit 44. Preferably, two symmetrical arms 90 are provided that have separated ends 92 opposite from the LEDs 28 so that the arms 90 can be snapped around the conduit 44.

Figure 12:
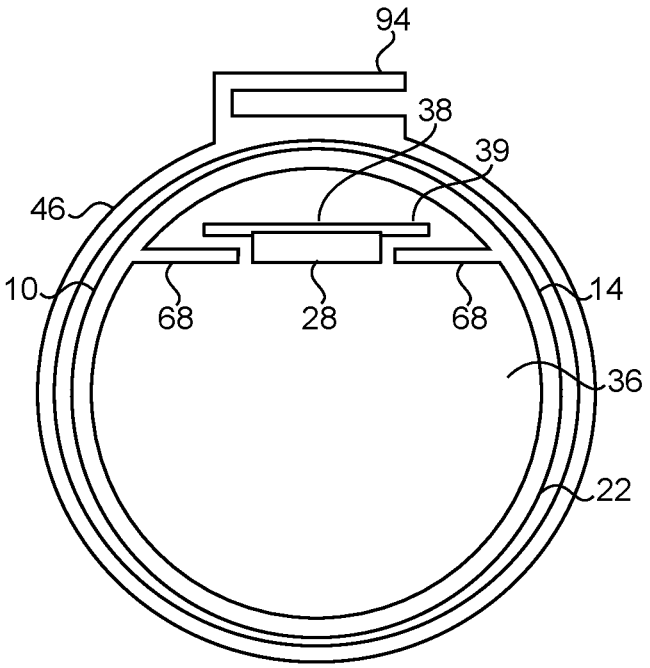
FIG. 12 is a cross-sectional view of a bracket for the light.

Various brackets 46 may be used to attach the lights 10 described herein to structures within a work area. For example, as shown in FIG. 12, a bracket 46 may encircle the elongated housing 14 or body 14. The bracket 46 may also be provided with a hook 94 to hang the light 10 from various structures within the work area.

Figure 13:
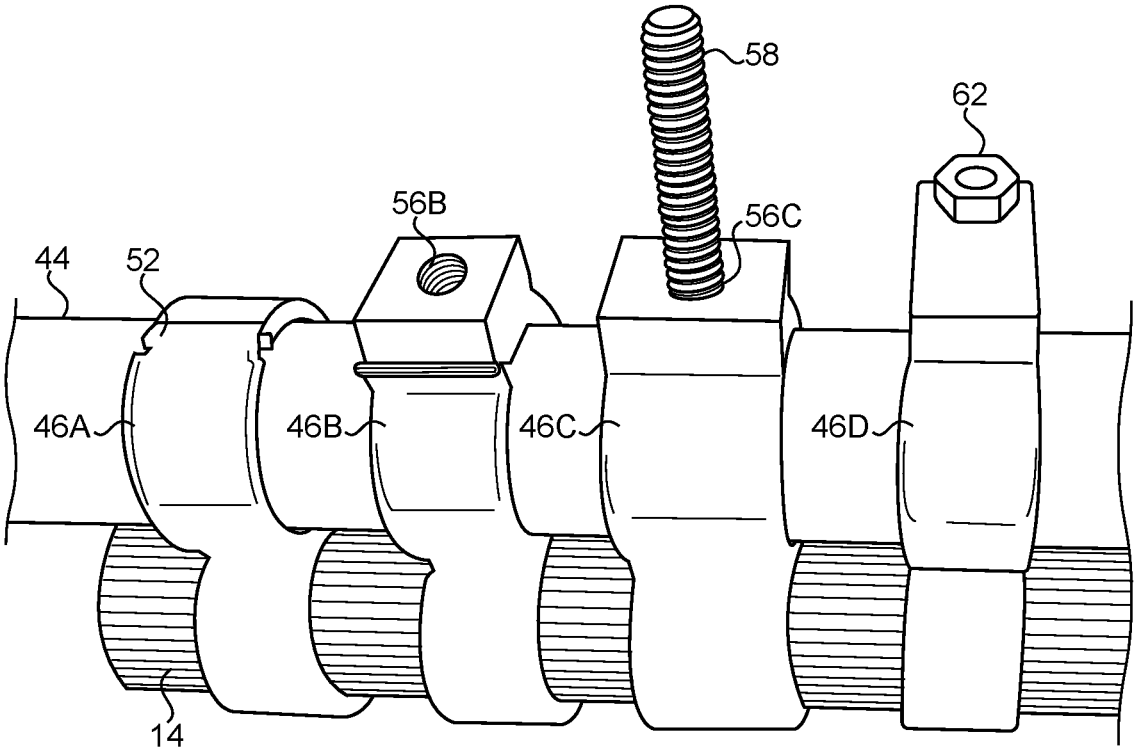
FIG. 13 is a perspective view of embodiments of another bracket, showing the bracket wrapped around the light and a conduit.
Figure 14A:
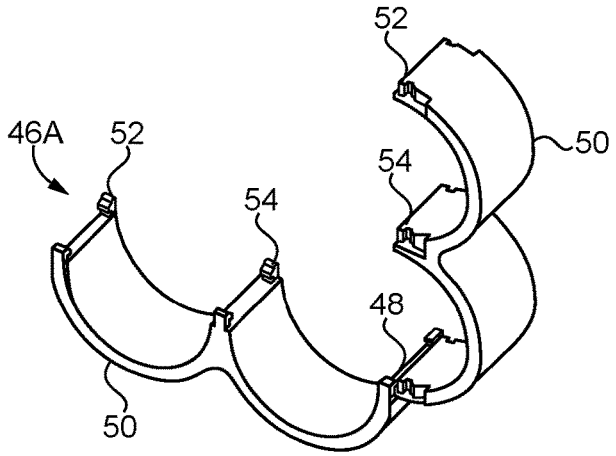
FIG. 14A is a perspective view of a first embodiment of the bracket of FIG. 13.
Figure 14B:
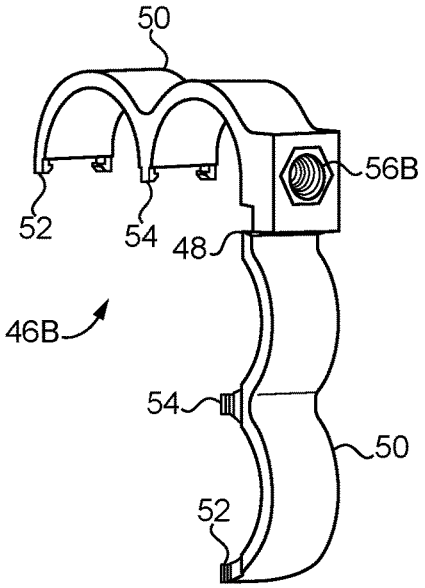
FIG. 14B is a perspective view of a second embodiment of the bracket of FIG. 13.
Figure 14C:
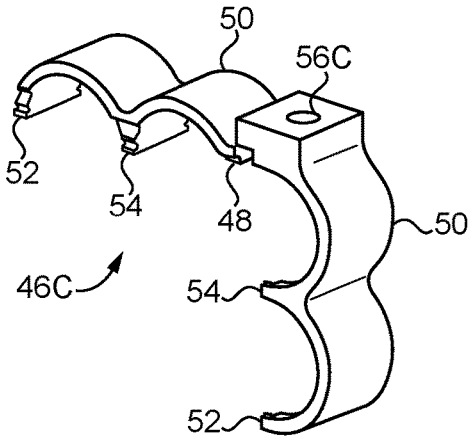
FIG. 14C is a perspective view of a third embodiment of the bracket of FIG. 13.
Figure 14D:
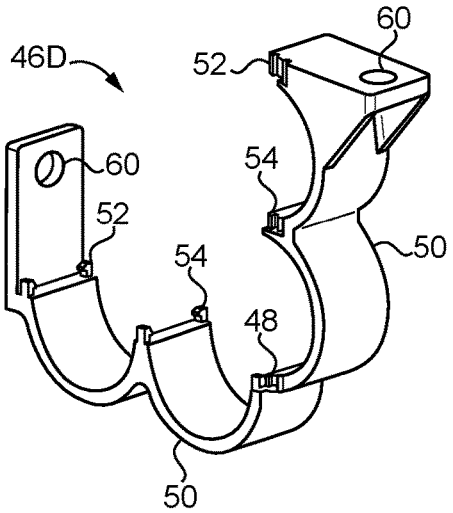
FIG. 14D is a perspective view of a fourth embodiment of the bracket of FIG. 13.

As shown in FIGS. 13-14D, it may be useful to install the light 10 along conduits 44 of a building structure. For example, it may be useful to use existing conduits 44 used for electrical cables or for fluid or gas plumbing. Preferably, such conduits 44 are metal conduits 44, although non-metallic conduits 44 are also possible. As shown in FIG. 13, in such an arrangement, the elongated housing 14 of the light 10 extends parallel to the conduit 44. In most arrangements, the light 10 will be positioned underneath the conduit 44. The light may also be used with commonly available structures, such as beams or purlins.

In order to attach the light 10 to a conduit 44, brackets 46 may be provided that wrap around the conduit 44 and the light 10. As shown in FIG. 13, the brackets 46A-D wrap around at least a portion of the conduit 44 and around at least a portion of the elongated housing 14 to attach the light housing 14 to the conduit 44. Typically, multiple brackets 46 will be spaced along the length of the elongated housing 14 and the conduit 44 to provide a secure installation. Four different versions of the bracket 46 are shown in FIGS. 13-14D. In each of the versions, it may be desirable for the bracket 46 to have a hinge 48 to allow the two sides 50 of the bracket 46 to fold around the light 10 and the conduit 44. For example, the hinge 48 may be a living hinge 48 integral to a plastic material forming the bracket 46.

In the bracket 46A of FIG. 14A, snaps 52 may be provided at opposite ends to snap the bracket 46A closed around the light 10 and the conduit 44. It may also be desirable to provide intermediate snaps 54 to snap the middle of the bracket 46 closed as well to provide additional securement. Further, although not necessary, it may be desirable as shown in each of the embodiments for the bracket 46 to wrap completely around the elongated housing 14 and completely around the conduit 44. In the brackets 46B, 46C of FIGS. 14B and 14C, the brackets 46B, 46C may be provided with a connector 56B, 56C that may be used to attach the light 10 and the conduit 44 to a building structure. For example, the conduit 44 and the light 10 may be attached to a ceiling, wall, support brace or other pre-existing structure in the building. In FIG. 14B, the connector 56B may be a threaded hole 56B in the bracket 46B. Alternatively, in FIG. 14C, the connector 56C may be a hole 56C for a threaded stud 58. In FIG. 14D, it may be desirable to provide holes 60 through the ends of the bracket 46D to attach the ends together with a metal fastener 62 like a bolt and nut 62.

Figure 15:
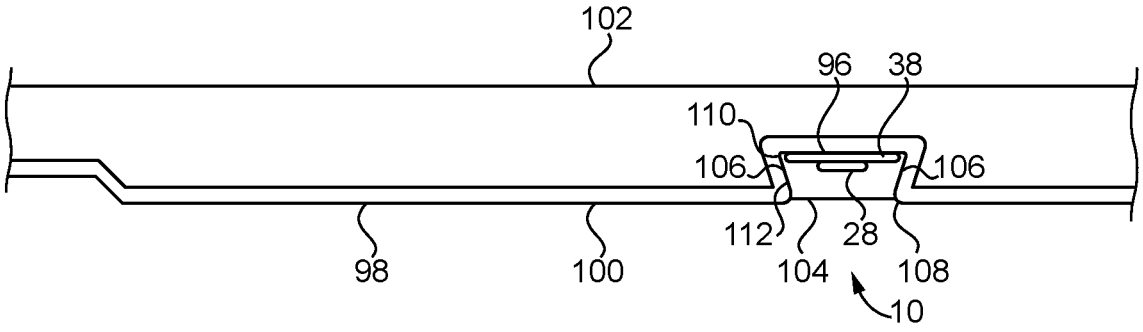
FIG. 15 is a cross-sectional view of another embodiment of the light.
Figure 16:
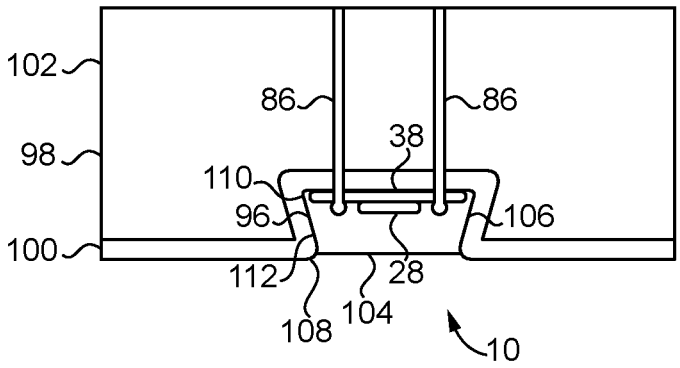
FIG. 16 is a cross-sectional view of a power conversion module for the light of FIG. 15.

As shown in FIGS. 15-16, the light 10 may also be attached to recesses 96 in a wall panel 98. Although various wall panels 98 may be used, a wall panel 98 with a metal exterior 100 and an insulated backing 102 may be desirable. One advantage of this arrangement is that the exposed surface 104 of the light 10 may form a portion of the wall surface to form a flat surface without noticeable recesses in the wall so that the exposed surface 104 of the light 10 is easy to clean and the wall 98 and light 10 combination provides an aesthetically integrated appearance. Preferably, the recess 96 in the wall panel 98 and the side surfaces 106 of the elongated body 14 are shaped complementary to each other so that the light 10 is retained in the recess 96. For example, the recess 96 may have a smaller opening 108 than the rear portion of the recess 96. The elongated body 14 may also have a rear width 110 that is larger than the front width 112 of the elongated body 14. Thus, the elongated body 14 is trapped within the recess 96. Although an elongated housing 14 as described above may be used, it may be desirable to use an elongated body 14 formed of a flexible polymer so that the elongated body 14 can be squeezed into the recess 96. Electrical contact with the power conversion module 12 may be accomplished with leads 86 that penetrate the rear of the strip 38 of LEDs 28 and extend rearward through the insulating backing 102 as shown in FIG. 16.

While preferred embodiments of the inventions have been described, it should be understood that the inventions are not so limited, and modifications may be made without departing from the inventions herein. While each embodiment described herein may refer only to certain features and may not specifically refer to every feature described with respect to other embodiments, it should be recognized that the features described herein are interchangeable unless described otherwise, even where no reference is made to a specific feature. It should also be understood that the advantages described above are not necessarily the only advantages of the inventions, and it is not necessarily expected that all of the described advantages will be achieved with every embodiment of the inventions. The scope of the inventions is defined by the appended claims, and all devices and methods that come within the meaning of the claims, either literally or by equivalence, are intended to be embraced therein.

The invention claimed is:

1. A light, comprising:

an elongated housing comprising an elongated interior space extending therein and an elongated translucent portion extending therealong;

a plurality of LEDs disposed within the elongated interior space and extending along a majority of a length of the elongated housing;

a power conversion module configured to convert electricity from a power supply to electrical power for the LEDs; and a cap at an end of the elongated housing;

wherein the elongated housing comprises a uniform cross-section therealong with an integral longitudinal support structure within the interior space, the elongated housing and the integral longitudinal support structure being extruded together such that the elongated housing and the integral longitudinal support structure are integral with each other, and the support structure retaining the LEDs.

2. The light according to claim 1, wherein the elongated housing is a tube formed of a translucent material.

3. The light according to claim 1, wherein the elongated housing is a tube, the tube comprising two of the integral longitudinal support structures angled relative to each other, each of the support structures retaining a group of the LEDs such that two groups of the LEDs are oriented in different directions.

4. The light according to claim 1, wherein the LEDs comprise first and second groups of LEDs, the first group of the LEDs being retained by the support structure, and a reflector being disposed between the first and second groups of LEDs, the reflector and the second group of LEDs being disposed behind the first group of LEDs, light from the second group of LEDs being redirected by the reflector.

5. The light according to claim 1, wherein the elongated translucent portion comprises a prismatic surface along an inner surface thereof and defining at least a portion of the elongated interior space, and an outer surface thereof comprising a smooth surface.

6. The light according to claim 1, further comprising a metallic structural member embedded within a wall of the elongated housing.

7. The light according to claim 1, wherein the power conversion module is removably attached to a first end of the elongated housing, a seal being disposed between the power conversion module and the elongated housing to hermetically seal the removable attachment, and the power conversion module and the seal slide over a smooth outer surface of the elongated housing.

8. The light according to claim 1, wherein the power conversion module is disposed at a first end of the elongated housing and the cap is disposed at a second end of the elongated housing, and a power converter within the power conversion module and a portion of electrical wires of the power supply connected to the power converter are embedded in a polymer body.

9. The light according to claim 8, wherein the polymer body comprises a threaded portion configured to be threadably connected to a conduit, the electrical wires extending out of the polymer body through an end of the threaded portion.

10. A light, comprising:

an elongated body made of a polymer and comprising at least a portion made of a translucent polymer;

a plurality of LEDs embedded in the elongated body and extending along a majority of a length of the elongated body; and a power conversion module configured to convert electricity from a power supply to electrical power for the LEDs;

wherein the elongated body and the power conversion module are hermetically sealed;

wherein the plurality of LEDs and the elongated body are coextruded together to embed the plurality of LEDs in the elongated body.

11. The light according to claim 10, wherein the elongated body comprises an arm wrapping around a conduit to thereby attach the light to the conduit.

12. The light according to claim 10, wherein electrical leads penetrate through the polymer of the elongated body to electrically connect the power conversion module to the LEDs.

13. The light according to claim 10, wherein the elongated body has a rear width larger than a front width thereof, the elongated body being disposed within a recess of a wall panel comprising a rear width larger than a front width thereof, the elongated body thereby being retained within the recess of the wall panel.

14. A light, comprising:

an elongated housing comprising an elongated interior space extending therein and an elongated translucent portion extending therealong;

a plurality of LEDs disposed within the elongated interior space and extending along a majority of a length of the elongated housing;

a power conversion module configured to convert electricity from a power supply to electrical power for the LEDs; and a cap at an end of the elongated housing; and a metallic structural member embedded within a wall of the elongated housing, the metallic structural member and the elongated housing being coextruded or injection molded together to embed the metallic structural member within the wall of the elongated housing.

15. The light according to claim 14, wherein the elongated housing comprises a uniform cross-section therealong with an integral longitudinal support structure within the interior space, the elongated housing and the integral longitudinal support structure being extruded together such that the elongated housing and the integral longitudinal support structure are integral with each other, and the support structure retaining the LEDs.

16. The light according to claim 14, wherein the elongated housing is a tube formed of a translucent material.

17. The light according to claim 14, wherein the elongated translucent portion comprises a prismatic surface along an inner surface thereof and defining at least a portion of the elongated interior space, and an outer surface thereof comprising a smooth surface.

18. The light according to claim 14, wherein the power conversion module is removably attached to a first end of the elongated housing, a seal being disposed between the power conversion module and the elongated housing to hermetically seal the removable attachment, and the power conversion module and the seal slide over a smooth outer surface of the elongated housing.

19. The light according to claim 14, wherein the power conversion module is disposed at a first end of the elongated housing and the cap is disposed at a second end of the elongated housing, and a power converter within the power conversion module and a portion of electrical wires of the power supply connected to the power converter are embedded in a polymer body.

20. The light according to claim 19, wherein the polymer body comprises a threaded portion configured to be threadably connected to a conduit, the electrical wires extending out of the polymer body through an end of the threaded portion.

* * * * *